US006460539B1

(12) United States Patent
Japuntich et al.

(10) Patent No.: US 6,460,539 B1
(45) Date of Patent: Oct. 8, 2002

(54) RESPIRATOR THAT INCLUDES AN INTEGRAL FILTER ELEMENT, AN EXHALATION VALVE, AND IMPACTOR ELEMENT

(75) Inventors: Daniel A. Japuntich, St. Paul, MN (US); Nicole V. McCullough, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 183 days.

(21) Appl. No.: 09/667,406

(22) Filed: Sep. 21, 2000

(51) Int. Cl.[7] ..... A62B 7/10; A62B 23/02

(52) U.S. Cl. ..... 128/205.27; 128/206.19; 128/205.29; 128/206.22; 128/205.12

(58) Field of Search ..... 128/200.27, 200.29, 128/206.19, 205.17, 205.29, 206.22, 201.25, 205.12, 200.28, 205.26, 206.12, 206.15, 206.17, 206.21, 206.24; 137/852, 855

(56) References Cited

U.S. PATENT DOCUMENTS

| | | | | |
|---|---|---|---|---|
| 812,706 A | * | 2/1906 | Warbasse | 128/207.12 |
| 1,077,272 A | * | 11/1913 | Graybill et al. | 128/206.15 |
| 1,288,856 A | * | 12/1918 | Farr | 128/206.15 |

(List continued on next page.)

FOREIGN PATENT DOCUMENTS

| | | |
|---|---|---|
| CA | 83962 | 5/1998 |
| DE | 666367 | 10/1938 |
| DE | 3701375 A1 | 10/1987 |
| DE | 43 07 754 A1 | 4/1994 |
| EP | 0 087 229 A1 | 8/1983 |
| EP | 0 171 551 A2 | 2/1986 |
| EP | 0 281 650 A1 | 9/1988 |
| FR | 746196 | 5/1933 |
| FR | 857420 | 9/1940 |
| GB | 2 233 905 A | 1/1991 |
| WO | WO 96/28217 | 9/1996 |
| WO | WO 00/04957 | 2/2000 |

OTHER PUBLICATIONS

U.S. Dept of Health & Human Services, *Guidelines for Preventing the Transmission of Mycobacterium Tuberculosis in Health Care Facilities*, Morbidity and Mortality Weekly Report, v. 43, n. RR–13, pp. 34 & 98 (Oct. 28, 1994).

*Proposed Recommended Practice for OR Wearing Apparel*, AORN Journal, v. 33, n. 1, pp. 100–104, 1 01 (Jan. 1981).

Vesley, D., et al., *Clinical Implications of Surgical Mask Retention Efficiencies for Viable and Total Particles*, Infections in Surgery, pp. 531–536, 533 (Jul. 1983).

*Primary Examiner*—Dennis Ruhl
*Assistant Examiner*—Michael G. Mendoza
(74) *Attorney, Agent, or Firm*—Karl G. Hanson

(57) ABSTRACT

A negative pressure respirator 20' that has an integrally-disposed filter element 28 and that covers at least the nose and mouth of a wearer. The respirator 20' includes an exhalation valve 22 and an impactor element 50 that covers the exhalation valve 22. The exhalation valve 22 has a diaphragm and an orifice and opens in response to increased pressure when the wearer exhales to allow exhaled air to be rapidly purged from the mask interior. The impactor element 50 is positioned in the exhale flow stream to remove particles and other contaminants from the exhaled air. The exhalation valve and impactor element have a ratio of $Z_n$:$D_j$ of less than about 5. The respirator 20' is beneficial because it provides comfort to the wearer by allowing warm, moist, high-$CO_2$-content air to be rapidly-evacuated from the mask interior through the valve 22 and also protects the wearer from splash-fluids and from polluted air while at the same time protecting other persons or items from being exposed to particles and other contaminants exhaled by the wearer.

39 Claims, 5 Drawing Sheets

U.S. PATENT DOCUMENTS 1,292,115 A * 1/1919 Soderling ..... 128/206.11
1,701,277 A * 2/1929 Shindel ..... 128/207.12
1,925,764 A 9/1933 Le Duc
2,111,995 A 3/1938 Schwartz
2,284,949 A 6/1942 Cover
2,348,108 A * 5/1944 Bulbulian ..... 128/201.13
2,435,653 A 2/1948 Maurer ..... 128/201.15
2,619,085 A * 11/1952 Bradley ..... 128/206.15
2,830,584 A * 4/1958 Hollman ..... 128/205.24
2,881,795 A * 4/1959 Waldenmaier ..... 137/855
2,898,908 A * 8/1959 Sovinsky ..... 128/201.15
3,460,168 A * 8/1969 Bruyne ..... 137/544
3,460,558 A * 8/1969 Johannisson ..... 137/102
3,473,165 A 10/1969 Gran et al.
3,550,588 A * 12/1970 Stahl ..... 128/201.15
3,603,313 A 9/1971 Arblaster
3,807,444 A 4/1974 Fortune ..... 137/512.1
4,175,937 A 11/1979 Brandau et al.
4,411,603 A 10/1983 Kell ..... 128/DIG. 12
4,536,440 A 8/1985 Berg
4,537,189 A 8/1985 Vicenzi
4,549,543 A 10/1985 Moon
4,573,464 A 3/1986 Yo ..... 128/206.15
4,630,604 A 12/1986 Montesi ..... 128/206.15
4,765,325 A 8/1988 Crutchfield
4,774,942 A 10/1988 Moellers
4,807,619 A 2/1989 Dyrud
4,827,924 A 5/1989 Japuntich
4,850,346 A 7/1989 Michel et al. ..... 128/206.15
4,856,120 A 8/1989 Hart ..... 2/428
4,901,716 A 2/1990 Stackhouse et al.
4,934,362 A 6/1990 Braun ..... 128/206.15
5,036,840 A 8/1991 Wallace
5,036,842 A 8/1991 van der Smissen et al.
5,086,768 A 2/1992 Niemeyer
5,117,821 A 6/1992 White
D347,298 S 5/1994 Japuntich et al.
D347,299 S 5/1994 Bryant et al.
5,307,796 A 5/1994 Kronzer
5,325,892 A 7/1994 Japuntich et al.
5,329,643 A 7/1994 Sato ..... 128/200.29
5,357,947 A 10/1994 Adler
5,366,726 A 11/1994 Debs et al.
5,413,142 A 5/1995 Johnson et al. ..... 137/515.5
5,479,920 A 1/1996 Piper et al.
5,505,197 A 4/1996 Scholey
5,509,436 A 4/1996 Japuntich et al.
5,570,684 A 11/1996 Behr
5,595,173 A 1/1997 Dodd, Jr.
5,617,849 A 4/1997 Springett et al.
5,676,133 A 10/1997 Hickle et al.
5,687,767 A 11/1997 Bowers
5,697,105 A 12/1997 White
5,724,964 A 3/1998 Brunson et al.
5,735,265 A 4/1998 Flynn
5,941,244 A 8/1999 Yamazaki et al.
D416,323 S 11/1999 Henderson et al.
6,014,971 A 1/2000 Danisch et al.
6,041,782 A 3/2000 Angadjivand
D424,688 S 5/2000 Bryant et al.
6,123,077 A 9/2000 Bostock et al.
D431,647 S 10/2000 Henderson et al.

* cited by examiner

RESPIRATOR THAT INCLUDES AN INTEGRAL FILTER ELEMENT, AN EXHALATION VALVE, AND IMPACTOR ELEMENT

The present invention pertains to a respirator that has an integrally-disposed filter element in its mask body and that has an impactor element associated with its exhalation valve. The impactor element allows the respirator to remove particulate contaminants from the exhale flow stream.

BACKGROUND

Filtering face masks are typically worn over a person's breathing passages for two common purposes: (1) to prevent contaminants from entering the wearer's respiratory system; and (2) to protect other persons or items from being exposed to pathogens and other contaminants expelled by the wearer. In the first situation, the face mask is worn in an environment where the air contains substances that are harmful to the wearer—for example, in an auto body shop. In the second situation, the face mask is worn in an environment where there is a high risk of infection or contamination to another person or item—for example, in an operating room or in a clean room.

Face masks that have been certified to meet certain standards established by the National Institute for Occupational Safety and Heath (generally known as NIOSH) are commonly referred to as "respirators"; whereas masks that have been designed primarily with the second scenario in mind—namely, to protect other persons and items—are generally referred to as "face masks" or simply "masks".

A surgical mask is a good example of a face mask that frequently does not qualify as a respirator. Surgical masks are typically loose-fitting face masks that are designed primarily to protect others from contaminants that are exhaled by a doctor or other medical person. Substances that are expelled from a wearer's mouth are commonly in the form of an aerosol, which is a suspension of fine solids and/or liquid particles in gas. Surgical masks are capable of removing these particles despite being loosely fitted to the wearer's face. U.S. Pat. No. 3,613,678 to Mayhew discloses an example of a loose fitting surgical mask.

Loose-fitting masks, typically do not possess an exhalation valve to purge exhaled air from the mask interior. The loose-fitting aspect allows exhaled air to easily escape from the mask's sides—known as blow by—so that the wearer does not feel discomfort, particularly when breathing heavily. Because these masks are loose fitting, however, they may not fully protect the wearer from inhaling contaminants or from being exposed to fluid splashes. In view of the various contaminants that are present in hospitals and the many pathogens that exist in body fluids, the loose-fitting feature is a notable drawback for loose-fitting surgical masks.

Some tightly-fitting face masks have a porous mask body that is shaped and adapted to filter inhaled air. The filter material is commonly integrally-disposed in the mask body and is made from electrically-charged melt-blown microfibers. These masks are commonly referred to as respirators and often possess an exhalation valve that opens under increased internal air pressure when the wearer exhales—see, for example, U.S. Pat. No. 4,827,924 to Japuntich. Examples of other respirators that possess exhalation valves are shown in U.S. Pat. Nos. 5,509,436 and 5,325,892 to Japuntich et. al., U.S. Pat. No. 4,537,189 to Vicenzi, U.S. Pat. No. 4,934,362 to Braun, and U.S. Pat. No. 5,505,197 to Scholey.

Known tightly-fitting respirators that possess an exhalation valve can prevent the wearer from directly inhaling harmful particles, but the masks have limitations when it comes to protecting other persons or things from being exposed to contaminants expelled by the wearer. When a wearer exhales, the exhalation valve is open to the ambient air, and this temporary opening provides a conduit from the wearer's mouth and nose to the mask exterior. The temporary opening can allow aerosol particles generated by the wearer to pass from the mask interior to the outside. Aerosol particles, such as saliva, mucous, blood, and sweat, are typically generated when the wearer sneezes, coughs, laughs, or speaks. Although sneezing and coughing tend to be avoided in environments such as an operating room—speech, a vital communication tool, is necessary for the efficient and proper functioning of the surgical team. Saliva particles are laden with bacteria. Unfortunately, aerosol particles that are generated by speaking can possibly lead to infection of a patient or contamination of a precision part.

The particles are made when saliva coated surfaces separate and bubble in response to the air pressure behind them, which commonly happens when the tongue leaves the roof of the mouth when pronouncing of the "t" consonant or when the lips separate while pronouncing the "p" consonant. Particles may also be produced by the bursting of saliva bubbles and strings near the teeth during sneezing or during pronunciation of such sounds as "cha" or "sss". These particles are generally formed under great pressures and can have projectile velocities greater than the air speed of normal human breath.

Mouth-produced particles have a great range in size, the smallest of which may average about 3 to 4 micrometers in diameter. The projectile particles, however, which leave the mouth and travel to a nearby third party, are generally larger, probably 15 micrometers or greater.

The settling rates of these airborne particles also affect their deposition on a nearby third party, such as a patient. Because particles that are less than 5 micrometers tend to settle at a rate of less than about 0.001 m/s, they are the equivalent of a floating suspension in the air.

Respirators that employ exhalation valves currently are not recommended for use in the medical field because the open conduit that the exhalation valve temporarily provides is viewed as hazardous. See, e.g., *Guidelines for Preventing the Transmission of Mycobacterium Tuberculosis in Health Care Facilities*, MORBIDITY AND MORTALITY WEEKLY REPORT, U.S. Dept. of Health & Human Services, v. 43, n. RR-13, pp. 34 & 98 (Oct. 28, 1994). The Association of Operating Room Nurses has recommended that masks be 95 percent efficient in retaining expelled viable particles. *Proposed Recommended Practice for OR Wearing Apparel*, AORN JOURNAL, v. 33, n. 1, pp. 100–104, 1 01 (January 1981); see also D. Vesley et al., *Clinical Implications of Surgical Mask Retention Efficiencies for Viable and Total Particles*, INFECTIONS IN SURGERY, pp. 531–536, 533 (July 1983). This recommendation was published in the early 1980s, and since that time, the standards for retaining particles have increased. Some organisms, such as those that cause tuberculosis, are so highly toxic that any decrease in the number of contaminants that are expelled is highly desired.

Respirators have been produced, which are capable of protecting both the wearer and nearby persons or objects from contamination. See, for example, U.S. Pat. No. 5,307,706 to Kronzer, U.S. Pat. No. 4,807,619 to Dyrud, and U.S. Pat. No. 4,536,440 to Berg. Commercially-available products include the 1860™ and 8210™ brand masks sold by 3M. Although these respirators are relatively tightly-fitting to prevent gases and liquid contaminants from entering and exiting the interior of the mask at its perimeter, the respirators commonly lack an exhalation valve that allows exhaled air to be quickly purged from the mask interior. Thus, known respirators can remove contaminants from the inhale and exhale flow streams and can provide splash-fluid protection, but they are generally unable to maximize wearer comfort. And when an exhalation valve is placed on a respirator to provide improved comfort, the mask encounters the drawback of allowing contaminants from the mask interior to enter the surrounding environment.

SUMMARY OF THE INVENTION

In view of the above, a respirator is needed, which can (i) prevent contaminants from passing from the wearer to the ambient air; (ii) prevent contaminants from passing from the ambient air to the wearer; (iii) prevent splash-fluids from entering the mask interior; and (iv) allow warm, humid, high $CO_2$-content air to be quickly purged from the mask's interior.

This invention provides such a respirator, which respirator in brief summary comprises: (a) a mask body that defines an interior gas space and an exterior gas space, the mask body comprising an integrally-disposed inhale filter layer for filtering inhaled air that passes through the mask body; (b) an exhalation valve disposed on the mask body, the exhalation valve having a valve diaphragm and at least one orifice, the valve diaphragm and the orifice being constructed and arranged to allow an exhale flow stream to pass from the interior gas space; to the exterior gas space; and (c) an impactor element that is disposed on the exhalation valve in the exhale flow stream; wherein the exhalation valve and impactor element provide the respirator with a ratio of $Z_n/D_j$ of less than about 5.

The invention has an impactor element that can prevent particles in the exhale flow stream from passing from the mask's interior gas space to the exterior gas space. The impactor element is associated with the respirator such that the ratio $Z_n/D_j$ is less than about 5. The use of an impactor element with an exhalation valve allows the respirator to be particularly beneficial for use in surgical procedures and for use in clean rooms. The inventive respirator may remove at least 95 percent, preferably at least 99 percent, of any suspended particles from the exhale flow stream. Further, the impactor element can prevent splash fluids from entering the interior gas space by providing a "no-line-of-sight" from the exterior gas space to the interior gas space. That is, the impactor element can be constructed to obstruct the view of the open orifice when the valve diaphragm is open during an exhalation. Unlike some previously-known face masks, the invention can be in the form of a tightly-fitting mask that provides good protection from airborne particles and from splash fluids. And because the inventive respirator possesses an exhalation valve, it can furnish the wearer with good comfort by being able to quickly purge warm, humid, high-$CO_2$-content air from the mask interior. In short, the invention is able to provide the wearer with a clean air source and protection from splash fluids, while at the same time make the mask comfortable to wear and prevent potentially-harmful particles from passing to the ambient environment.

GLOSSARY

In reference to the invention, the following terms are defined as set forth below:

"aerosol" means a gas that contains suspended particles in solid and/or liquid form;

"clean air" means a volume of air that has been filtered to remove particles and/or other contaminants;

"contaminants" mean particles and/or other substances that generally may not be considered to be particles (e.g., organic vapors, et cetera) but which may be suspended in air, including air in an exhale flow stream;

"exhalation valve" means a valve designed for use on a respirator to open in response to pressure from exhaled air and to remain closed between breaths and when a wearer inhales;

"exhaled air" is air that is exhaled by a person;

"exhale flow stream" means the stream of air that passes through an orifice of an exhalation valve;

"texterior gas space" means the ambient atmospheric air space into which exhaled gas enters after passing significantly beyond the exhalation valve and an impactor element;

"impactor element" means a substantially fluid impermeable structure that diverts the exhale flow stream from its initial path to remove a significant amount of suspended particles from the flow stream as a result of the flow stream diversion;

"inhale filter element" means a porous structure through which inhaled air passes before being inhaled by the wearer so that contaminants and/or particles can be removed from the air;

"integral" and "integrally-disposed" mean the filter element is not separably removable from the mask body without causing significant structural damage to the mask body;

"interior gas space" means the space into which clean air enters before being inhaled by the wearer and into which exhaled air passes before passing through the exhalation valve's orifice;

"mask body" means a structure that can fit at least over the nose and mouth of a person and that helps define an interior gas space separated from an exterior gas space;

"particles" mean any liquid and/or solid substance that is capable of being suspended in air, for example, pathogens, bacteria, viruses, mucous, saliva, blood, etc.;

"respirator" means a mask that supplies clean air to the wearer through a mask body that covers at least the nose and mouth of a wearer and when worn seals snugly to the face to ensure that inhaled air passes through a filter element;

"valve cover" means a structure that is provided over the exhalation valve to protect the valve against damage and/or distortion;

"valve diaphragm" means a moveable structure on a valve, such as a flap, that provides a generally air tight seal during inhalation and that opens during exhalation; and "$Z_n/D_j$" or "$Z_n:D_j$" means the ratio of the distance between the valve opening and the impactor element ($Z_n$) to the exhalation valve opening height ($D_j$) (see FIG. 10 and its discussion).

BRIEF DESCRIPTION OF THE DRAWINGS

Referring to the drawings, where like reference characters are used to indicate corresponding structure throughout the several views.

DETAILED DESCRIPTION OF PREFERRED EMBODIMENTS

According to various embodiments of the present invention, an impactor element is placed downstream or outside the exhalation valve orifice on the mask exterior so that particles in the exhale flow stream are collected by the impactor element after passing through the exhalation valve but before reaching the atmospheric air or exterior gas space. The impactor element may be placed downstream to the exhalation valve so that any air passing through the exhalation valve subsequently impacts the impactor element and is diverted. The impactor element is constructed and arranged to obstruct the view of the valve orifice from the exterior to reduce the opportunity for splash fluids to pass through the valve. The impactor element may cover not only the valve and/or the valve cover but may also cover larger portions of the mask body to provide increased deflection of the exhale flow stream and particles and contaminants and increased obstruction to external contaminants.

Figure 1:
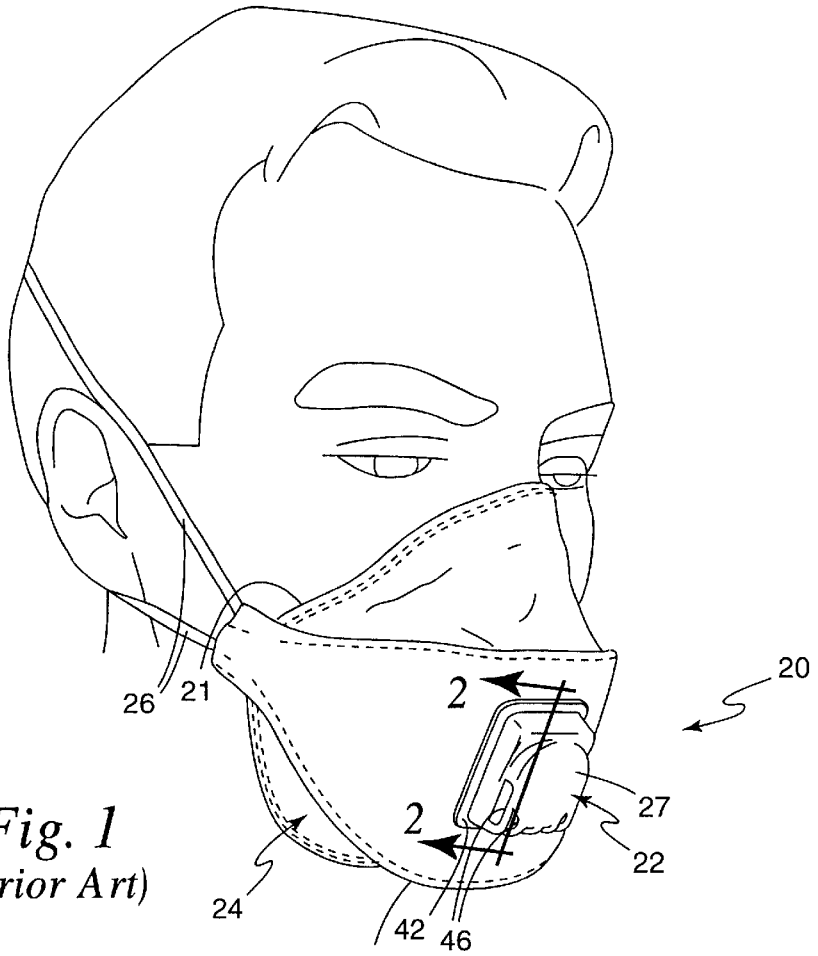
Fig. 1 (Prior Art)
FIG. 1 is a perspective view of a known negative pressure respiratory mask 20 that is fitted with an exhalation valve 22.

In FIG. 1, a known negative pressure respiratory mask 20 is shown. Negative pressure masks filter incoming air in response to a negative pressure that is created by the wearer's lungs during an inhalation. Mask 20 has an exhalation valve 22 disposed centrally on a mask body 24 that is configured in a generally cup-shaped configuration when worn to fit snugly over a person's nose and mouth. The respiratory mask 20 is formed to maintain a substantially leak free contact with the wearer's face at its periphery 21. Mask body 24 is drawn tightly against the wearer's face around the mask periphery 21 by a supporting harness that may include bands 26. As shown, the bands 26 extend behind the wearer's head and neck when the mask 20 is worn.

The respiratory mask 20 forms an interior gas space between the mask body 24 and the wearer's face. The interior gas space is separated from the atmospheric air or exterior gas space by the mask body 24 and the exhalation valve 22. The mask body may have a conformable nose clip (not shown) mounted on the interior or exterior of the mask body 24 (or outside or between various layers of the mask body) to provide a snug fit over the nose and where the nose meets the cheek bone. The nose clip may have the configuration described in U.S. Pat. No. 5,558,089 to Castiglione. A mask having the configuration shown in FIG. 1 is described in PCT Publication WO 96/28217 to Bostock et al.; in Canadian Design Patent Nos. 83,961 to Henderson et al., 83,960 to Bryant et al., and 83,962 to Curran et al.; and in U.S. Pat. No. Des. 424,688 to Bryant et al. and U.S. Pat. No. Des.416,323 to Henderson et al. Face masks of the invention may take on many other configurations, such as flat masks and cup-shaped masks shown, for example, in U.S. Pat. No. 4,807,619 to Dyrud et al. and U.S. Pat. No. 4,827,924 to Japuntich. The mask also could have a thermochromic fit-indicating seal at its periphery to allow the wearer to easily ascertain if a proper fit has been established—see U.S. Pat. No. 5,617,849 to Springett et al.

The exhalation valve 22 that is provided on mask body 24 opens when a wearer exhales in response to increased pressure inside the mask and should remain closed between breaths and during an inhalation. Valve cover 27 is located on and over exhalation valve 22 and protects valve 22, in particular the valve diaphragm or flap. Valve cover 27 is designed to protect valve 22 and the diaphragm from damage from airborne projectiles and other objects.

When a respirator wearer inhales, air is drawn through the filtering material to remove contaminants that may be present in the exterior gas space. Filter materials that are commonplace on negative pressure half mask respirators like the mask 20 shown in FIG. 1 often contain an entangled web of electrically-charged, melt-blown, microfibers. Melt-blown microfibers typically have an average fiber diameter of about 1 to 30 micrometers ($\mu$m), more commonly 2 to 15 $\mu$m. When randomly entangled, the fibrous webs can have sufficient integrity to be handled as a mat. Examples of fibrous materials that may be used as filters in a mask body are disclosed in U.S. Pat. No. 5,706,804 to Baumann et al., U.S. Pat. No. 4,419,993 to Peterson, U.S. Reissue Pat. No. Re 28,102 to Mayhew, U.S. Pat. Nos. 5,472,481 and 5,411,576 to Jones et al., and U.S. Pat. No. 5,908,598 to Rousseau et al.

The fibrous materials may contain fluorine atoms or additives to enhance filtration performance, including the fluorochemical additives described in U.S. Pat. Nos. 5,025,052 and 5,099,026 to Crater et al. The fibrous materials may also have low levels of extractable hydrocarbons to improve performance; see, for example, U.S. patent application Ser. No. 08/941,945 to Rousseau et al. Fibrous webs also may be fabricated to have increased oily mist resistance as shown in U.S. Pat. No. 4,874,399 to Reed et al, U.S. Pat. Nos. 5,472,481 and 5,411,576 to Jones et al., U.S. Pat. No. 6,068,799 and in PCT Publication WO 99/16532, both to Rousseau et al. Electric charge can be imparted to nonwoven melt-blown fibrous webs using techniques described in, for example, U.S. Pat. No. 5,496,507 to Angadjivand et al., U.S. Pat. No. 4,215,682 to Kubik et al., and U.S. Pat. No.

4,592,815 to Nakao, and U.S. patent application Ser. No. 09/109,497 to Jones et al., entitled Fluorinated Electret (see also PCT Publication WO 00/01737.

Figure 2:
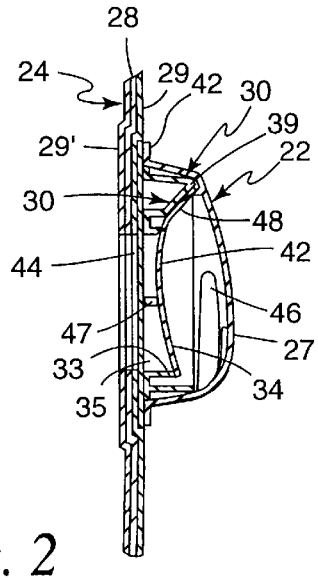
Fig. 2 (Prior Art)
FIG. 2 is a sectional side view taken through the exhalation valve 22 along lines 2—2 in FIG. 1.

FIG. 2 shows the exhalation valve 22 in cross-section mounted on the mask body 24. Mask body 24 has an integrally-disposed inhale filter element or layer 28, an outer cover web 29, and an inner cover web 29'. The inhale filter element 28 is integral with the mask body 24. That is, it forms a part of the mask body and is not a part that is removably attached to the mask body. The outer and inner cover webs 29 and 29' protect the filter layer 28 from abrasive forces and retain fibers that may come loose from the filter layer 28. The cover webs 29, 29' may also have filtering abilities, although typically not nearly as good as the filtering layer 28. The cover webs may be made from nonwoven fibrous materials that contain polyolefins and polyesters (see, e.g., U.S. Pat. Nos. 4,807,619 and 4,536,440 and U.S. patent application Ser. No. 08/881,348 filed Jun. 24, 1997).

The mask body also typically includes a support or shaping layer to provide structural integrity to the mask. A typical shaping layer contains thermally bonding fibers such as bicomponent fibers and optionally staple fibers. Examples of shaping layers that may be used in respirators of the invention are disclosed, for example, in U.S. Pat. No. 5,307,796 to Kronzer, U.S. Pat. No. 4,807,619 to Dyrud, and U.S. Pat. No. 4,536,440 to Berg. The shaping layer also can be in the form of a polymeric mesh or netting like the materials used by Moldex Metric in its 2700 N95 respiratory products.

The exhalation valve 22 that is mounted to mask body 24 includes a valve seat 30 and a flexible flap 32 that is mounted to the valve seat in cantilevered fashion. The flexible flap 32 rests on a seal surface 33 when the flap is closed but is lifted from the surface 33 at free end 34 when a significant pressure is reached during an exhalation. The resistance to lifting should not be so great that the exhaled air substantially passes through the mask body 24 rather than through exhalation valve 22. When the wearer is not exhaling, the flap 32 is preferably tightly sealed against (or biased towards) surface 33 to provide a hermetic seal at that location. The seal surface 33 of the valve seat 30 may curve in a generally concave cross-section when viewed from a side elevation.

Figure 3:
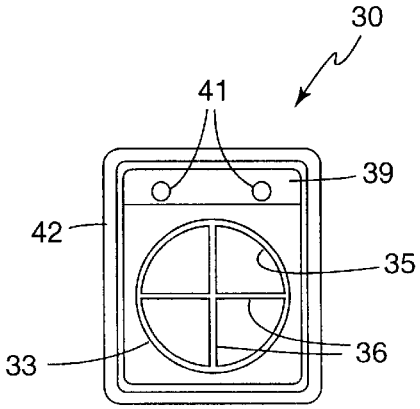
Fig. 3 (Prior Art)
FIG. 3 is a front view of a valve seat 30 that is used in valve 22 of FIGS. 1 and 2.

FIG. 3 shows the valve seat 30 from a front view. The valve seat 30 has an orifice 35 that is disposed radially inward to seal surface 33. Orifice 35 may have cross members 36 that stabilize the seal surface 33 and ultimately the valve 22 (FIG. 2). The cross members 36 also can prevent flap 32 (FIG. 2) from inverting into orifice 35 during inhalation. The flexible flap 32 is secured at its fixed portion 38 (FIG. 2) to the valve seat 30 on flap retaining surface 39. Flap retaining surface 39, as shown, is disposed outside the region encompassed by the orifice 35 and can have pins 41 or other suitable means to help mount the flap to the surface. Flexible flap 32 (FIG. 2) may be secured to surface 39 using sonic welding, an adhesive, mechanical clamping, and the like. The valve seat 30 also has a flange 42 that extends laterally from the valve seat 30 at its base to provide a surface that allows the exhalation valve 22 (FIG. 2) to be secured to mask body 24. The valve 22 shown in FIGS. 2 and 3 is more fully described in U.S. Pat. Nos. 5,509,436 and 5,325,892 to Japuntich et al. This valve and others described by Japuntich et al. are preferred valve embodiments for use with the invention. Other valve structures, designs and configurations may also be used.

Air that is exhaled by the wearer enters the mask's interior gas space, which in FIG. 2 would be located to the left of mask body 24. Exhaled air leaves the interior gas space by passing through an opening 44 in the mask body 24. Opening 44 is circumscribed by the valve 22 at its base 42. After passing through the valve orifice 35, the exhaled air passes though valve ports 46 in valve cover 27 and then into the exterior gas space. A portion of the exhaled air may exit the interior gas space through the inhale filtering element rather than passing through the valve orifice 35. The amount of this air is minimized as the resistance through valve orifice 35 is decreased.

Figure 4:
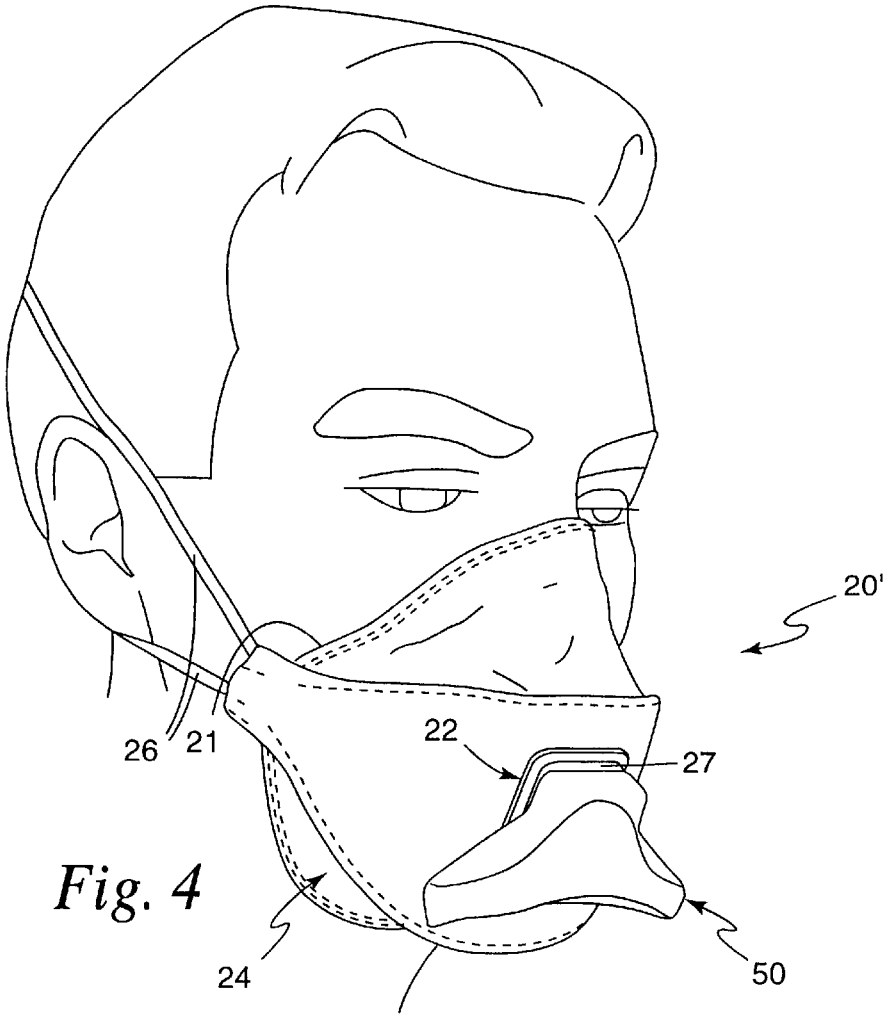
FIG. 4 is a perspective view of a respirator 20' that is fitted with an exhalation valve 22 and an impactor element 50 in accordance with the invention.

FIG. 4 illustrates a respiratory mask 20', similar to the mask shown in FIG. 1, except that in FIG. 4 the respirator 20' has an impaction device or impactor element 50, that can collect and retain particles present in the exhale flow stream. Impactor element 50 is attached to the exhalation valve 22 and preferably covers a majority of valve cover 27 and valve ports 46 (FIG. 1). Impactor element 50 is located in the exhale flow stream and removes particles from it—for example, particles suspended in the wearer's exhaled aerosol—by sharply redirecting the flow.

Figure 5:
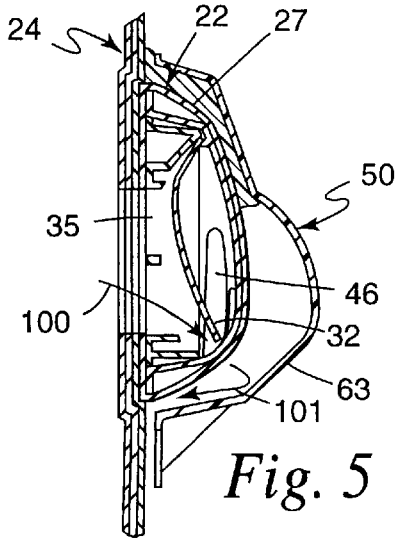
FIG. 5 is a side view taken in cross-section, which illustrates the path of the exhale flow stream 100 when diverted or deflected 101 by the impactor element 50 in accordance with the invention.

FIG. 5 illustrates the redirection of the exhale flow stream 100 through the valve 22. After passing through the valve orifice 35, the exhale flow stream 100 lifts the diaphragm 32 and flows through valve port 46 in valve cover 27. Once through valve cover 27, the air collides with the impactor element 50 and is deflected and diverted as a diverted exhale-flow-stream 101 to either one side or the other. Thus, the exhaled air that leaves the interior gas space through valve orifice 35 proceeds through ports 46 in the valve cover 27 and then is deflected by the impactor element 50 to subsequently enter the exterior gas space. Any particles that are not collected by the impactor are diverted along with the exhale flow stream away from surrounding people and objects. Essentially all exhaled air not flowing through the mask body's filtering material 28 should flow through the exhalation valve 22 and be diverted or deflected to allow suspended particles to impact on the impactor element 50.

As indicated, the valve cover 27 extends over the exterior of the valve seat 30 and includes the ports 46 at the sides and top of valve cover 27. A valve cover having this configuration is shown in U.S. Pat. No. Des. 347,299 to Bryant et al. Other configurations of other exhalation valves and valve covers, of course, may also be utilized (see, for example, U.S. Pat. No. Des. 347,298 to Japuntich et al. for another valve cover). Valve cover 27 and valve ports 46 are designed to allow for passage of all exhaled air. The resistance or pressure drop through the valve cover 54 and the valve ports 46 is essentially none. Air should flow freely out of exhalation valve 22 and through valve cover 27 with minimal hindrance. The impactor element 50 is preferably seated on valve cover 27 so that all air passing through ports 46 is confronted by impactor 50.

The resistance or pressure drop through and past the impactor element of the present invention preferably is lower than the resistance or pressure drop through the mask body. Because dynamic fluids follow the path of least resistance, it is important to use an impactor element configuration that exhibits a lower pressure drop than the mask body, and preferably less than the filter layer in the mask body. Thus, the majority of the exhaled air will pass through the exhalation valve and will deflect off the impactor element, rather than exiting to the exterior through the filter media of the mask body. Most or substantially all exhaled air thus will flow from the mask body interior, out through the exhalation valve, and impact on the impactor element, which diverts the air. If airflow resistance due to the impactor element is too great so that air is not readily expelled from the mask interior, moisture and carbon dioxide levels within the mask can increase and may cause discomfort to the wearer.

Figure 6:
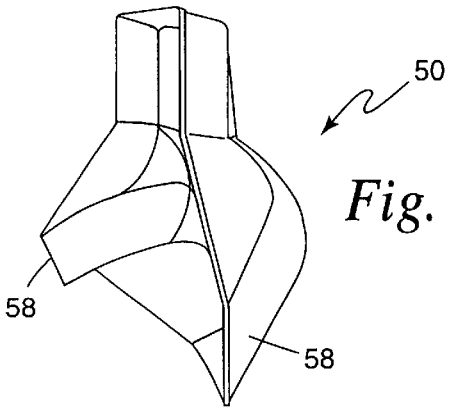
FIG. 6 is a perspective view of the impactor element 50 shown in FIG. 6.
Figure 7:
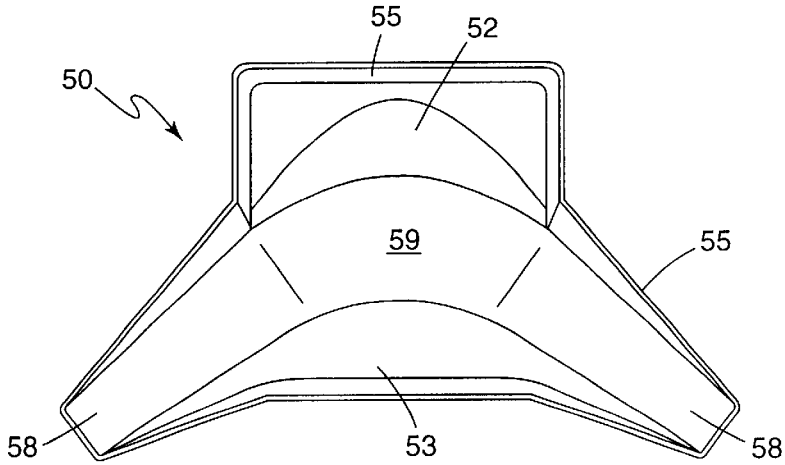
FIG. 7 is a front view of the impactor element 50 of FIG. 6.
Figure 8:
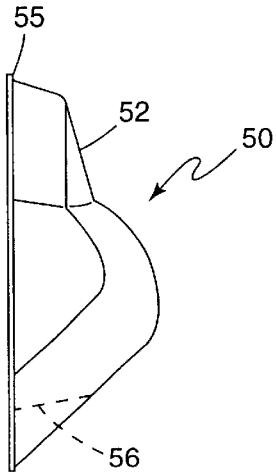
FIG. 8 is a side view of the impactor element 50 of FIG. 6.

FIGS. 6 through 8 show impactor element 50 from various viewpoints. The impactor element 50 preferably is a rigid, self supporting device that, in some embodiments, may be releasably attachable, that is, is removable and replaceable. Impactor element 50 has a cover plate 52 that preferably fittingly engages a valve cover 27. In a preferred embodiment, the cover plate 52 is molded to snap fit onto the valve cover 27. At the base of the cover plate 52 is a front plate 53, which is designed to be placed in the path of the exhale flow stream. That is, the front plate 53 is designed to directly align with ports 46 through which the exhale stream exits the exhalation valve 22. The exhale air stream passes through ports 46 and then is confronted by front plate 53, which changes the path of the air stream. Plate periphery 55 of cover plate 52 should provide a tight and leak-free seal between the valve cover 27 and impactor element 50 so that all exhaled air flows down and is diverted by front plate 53, rather than leaking out around cover plate 52.

The exhaled air is forced against front plate 53, to alter the air path. The majority of the air is sharply turned, preferably at an angle of at least about 90 degrees, in respect to its original path. Depending on the diameter and density of the contaminants and/or particles present in the exhale flow stream, the majority of the particles are unable to turn with the air stream, thus crossing the air stream and colliding with and impacting on the front plate 53 where the majority of the contaminants may be collected. A lip or trough 56 may be used to improve the retainment of the particles captured by impactor element 50.

The exhale flow stream is further diverted to either the left or right side of impactor element 50 by deflectors 58. Preferably, a cleavage ridge 59 aids in dividing the exhale flow stream so that proper diversion of air occurs. This sharp diversion of the exhale flow stream to either the left or right side facilitates the collection of the particles and contaminants on front plate 53 and the lip 56. Any particles or contaminants not collected by the impactor element 50 are diverted to either the left or right side and are exhausted into the exterior gas space away from the patient or other neighboring item.

Impactor 50 may be removable from and replaceable on valve cover 27. A removable impactor element may be configured to snap onto and form a tight seal at plate periphery 55 (FIG. 7) to the valve cover 27 or the impactor element may be attached to valve cover 27 by other methods, for example, by a repositionable pressure sensitive adhesive. A removable impactor element may be removed from the mask and placed onto a different mask, for example, if the first mask has met the end of its service life, or, if an impactor with different properties is desired on a specific mask.

In some embodiments, impactor element 50 may be integral with valve cover 27; that is, valve cover 27 and impactor element 50 are a single unit. Alternately, impactor element 50 may meet the functional requirements for a valve cover, thus eliminating the need for a valve cover.

The impactor element is preferably constructed from a rigid, yet somewhat flexible material that is substantially fluid impervious. Preferably, the impactor element is molded from either a thermoplastic or thermoset fluid impermeable plastic material but may be manufactured from essentially any material that allows it to serve its function. Typically, the impactor element is at least semi-rigid. Examples of materials that are suitable for making the impactor element may include polystyrene, polyethylene, polycarbonate, paper, wood, ceramics, sintered materials, microfibers, composites, and other materials. The impactor element may be cast, blow molded, injection molded, heat pressed, or made by basically any method for forming shaped articles. In some embodiments, a layer of absorbent porous material may be used, for example, paper or nonwoven material, that lines the interior surface of the impactor element. The impactor element may be opaque so that the collected particles are hidden from observers. Alternately, the impactor element could be transparent so that the valve can be seen (the optional valve cover would also have to be transparent too). Although a transparent impactor may not literally obstruct view of the valve diaphragm, a transparent impactor would nevertheless fall within the scope of the present invention if an opaque impactor, identical to the transparent impactor in shape and size, would obstruct the view of the valve diaphragm. The term "obstruct the view" thus refers to line-of-sight and not the transparency of the impactor and/or valve cover.

The impactor element should be sized so as to cover a significant portion of exhalation valve and optionally the valve cover, and in particular the valve's ports through which the exhale air stream flows. Typically, the impactor element is approximately 1 to 2 inches high (about 2.5 to 5 cm) from the top of the cover plate 52 to lip 56, and have a span of approximately 1 to 3 inches (about 2.5 to 7.5 cm) from one side deflector 54 to the other. Generally, the impactor has a thickness of a few millimeters. Lip or trough 56, if present, preferably has a ledge extending approximately 1 to 5 mm in from front plate 58, in order to collect and retain particles thereon. In some embodiments, it may be desirable that lip 56 has a concave shape. Preferably, impactor element 50 is shaped and sized so that it obstructs any straight-line path from the exterior gas space into the valve. There should be no "line of sight" from the exterior gas space past the impactor and the valve diaphragm into the interior gas space. That is, the impactor element 50 obstructs the view of the valve diaphragm. This obstructed sight path reduces the likelihood that contaminants, such as projectiles or droplets of blood, would enter the valve.

Referring again to FIG. 5, when the front plate 53 of impactor element 50 is positioned on valve cover 27, it generally is at a distance of about 0.1 to 2 cm from exhalation valve's flap or diaphragm 32, preferably less than about 1.5 cm, and more preferably less than about 1 cm from the closest distance to the diaphragm 32. The distance between the front plate 53 and the diaphragm 32, which valve cover 27 protects, can be critical in the operation of exhalation valve 22 in conjunction with impactor element 50. If front plate 53 is too close to the diaphragm 32, the impactor may restrict the air flow, thus decreasing the efficiency of the valve 22. Conversely, if front plate 53 is too far from the diaphragm, the velocity of the particles may not be sufficiently high so that the particles impact onto front plate 53. This loss of impaction would allow the particles and contaminants to be carried with the air flow stream that passes into the exterior gas space.

Figure 9:
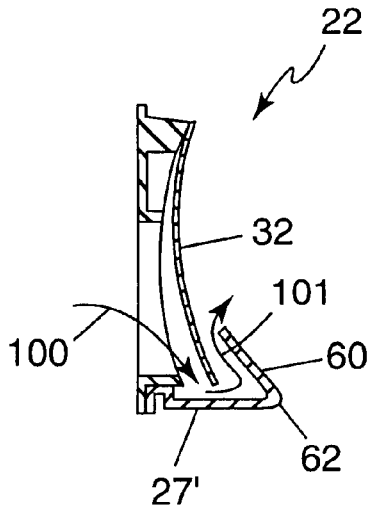
FIG. 9 is a cross-sectional side view of a second embodiment of an impactor element 80 in accordance with the invention.
Figure 10:
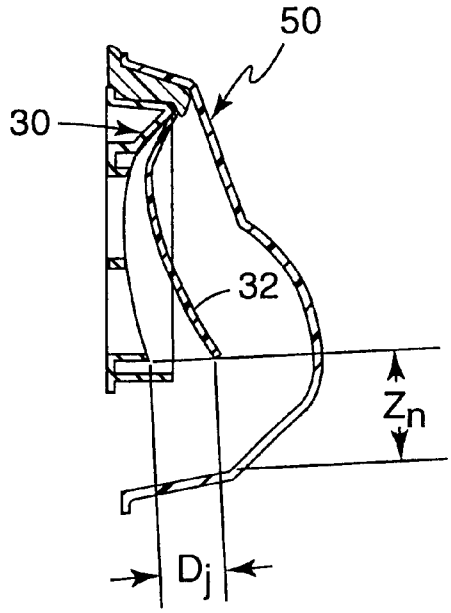
FIG. 10 is a cross-sectional side view of an impactor element 50 that is positioned on a valve in accordance with the invention, which side view illustrates the measurement positions for $Z_n$, and $D_j$.

FIG. 9 shows an exhalation valve 22 that has a valve cover 27' integral with an impactor element 60. Impactor element 60 includes as sharp bend 62 that can also function as a lip to retain trapped particles. The exhale air flow stream 100 is shown exiting the valve past diaphragm 32 on a set path but then is redirected by impactor element 60 (shown as redirected air stream 101). FIG. 10 shows an angle of deflection of about 160 degrees.

An impactor element functions by creating a bending air flow path that enables particles to strike the impactor surface and become removed from the flow stream. A critical point exists in the diverted air when a particle can no longer remain suspended in the air stream and diverts from the air flow and is collected. This point is dependent on the mass of the particle (that is, the size and density of the particle), the velocity of the air flow, and the path of the air flow. The impactor element is designed on the theory of changing the path of the air flow sufficiently so that the particle is unable to follow the changes in the flow path. Any particle that is not capable of following the air flow path impacts on, and is retained by, the impactor element.

Each particle has a certain momentum, which is a function of its mass multiplied by its velocity. There is a point for each particle where its momentum is too large to be shifted or turned by the air stream that is carrying it, resulting in the particle colliding with the obstruction that is deflecting the rest of the air flow. Impactor element collects these particles that are unable to turn to follow the air stream. Preferably, substantially all of the air exhaled through the valve is deflected by the impactor element, so that substantially all of the particles are retained by impactor element.

For impaction of a particle to occur, the particle should have a Stokes number (which describes the condition of particle momentum), for normal exhalation air flow, typically greater than about 0.3, when defined by the equation:

$$I = \frac{C_c \rho_p D_p^2 U_j}{18 \mu_f D_j},$$

where I is the Stokes Number, $C_c$ is the Cunnigham correction factor for slip flow, $\rho_p$ is the particle density, $D_p$ is the particle diameter, $U_j$ is the velocity of the jet of air leaving the valve opening at the opening height, $D_j$ is the valve diaphragm opening height, and $\mu_f$ is the viscosity of the air.

Even with a valve present on the respirator, filtration masks can remove a great percentage of particles from the exhaled air stream. Use of an impactor element with a valve, however, substantially increases the percentage of particles removed from the air stream that is exhaled to the environment, preferably to at least about 99.99%.

FIG. 10 illustrates the distance $Z_n$ from the diaphragm 32 to the impactor element 50 and the exhalation valve opening height $D_j$. The distance $Z_n$ is measured from the open valve diaphragm perpendicular to the impactor element, in the direction of a linear extension of the valve diaphragm from its tip when the valve is open and exposed to an airflow under the Normal Exhalation Test. The opening height of the valve, $D_j$, is measured at the widest opening under the Normal Exhalation Test.

A "Normal Exhalation Test" is a test that simulates normal exhalation of a person. The test involves mounting a filtering face mask to a 0.5 centimeter (cm) thick flat metal plate that has a circular opening or nozzle of 1.61 square centimeters ($cm^2$) (9/16 inch diameter) located therein. The filtering face mask is mounted to the flat, metal plate at the mask base such that airflow passing through the nozzle is directed into the interior of the mask body directly towards the exhalation valve (that is, the airflow is directed along the shortest straight line distance from a point on a plane bisecting the mask base to the exhalation valve). The plate is attached horizontally to a vertically-oriented conduit. Air flow sent through the conduit passes through the nozzle and enters the interior of the face mask. The velocity of the air passing through the nozzle can be determined by dividing the rate of airflow (volume/time) by the cross-sectional area of the circular opening. The pressure drop can be determined by placing a probe of a manometer within the interior of the filtering face mask. In measuring $D_j$, the air flow rate should be set at 79 liters per minute (lpm). For an impactor element in accordance with the present invention, the ratio of $Z_n/D_j$ is less than about 5, preferably less than about 4, more preferably less than about 2, and is typically greater than 0.5, preferably greater than 1, more preferably greater than 1.2. The Normal Exhalation Test is also mentioned in U.S. Pat. No. 5,325,892 to Japuntich et al. A mask that has an impactor that provides a $Z_n/D_j$ ratio according to the invention will provide an impactor element that may remove a majority of particles exiting through the exhalation valve on which the impactor is positioned.

In the design of industrial hygiene impactors for air sampling particle capture efficiency, the $Z_n/D_j$ ratio is usually correlated to the square root of the Stokes number. A summary of this technology is in the reference: T.T. Mercer, "Chapter 6, Section 6-3, Impaction Methods", Aerosol Technology in Hazard Evaluation, pp. 222–239, Academic Press, New York, N.Y., (1973). In T.T. Mercer (1973), for 50 percent capture efficiency of particles impacting on a flat surface from rectangular-shaped jets, the square root of the Stokes number needs to be greater than about 0.75 for $Z_n/D_j=1$ and about 0.82 for $Z_n/D_j=2$. Extrapolating from data from Mercer for 95% particle capture efficiency of particles impacting on a flat surface from round-shaped jets, the square root of the Stokes number should be greater than about 0.6 for $Z_n/D_j=1$ and 0.5 for $Z_n/D_j=2$. In general, for capture of over 95% of particles expelled by a valve in a filtering face respirator, the square root of the Stokes number is preferably greater than 0.5 for $,/D_j=2$ and greater than 0.6 for $Z_n/D_j=1$.

The impactor element provides a level of protection to other persons or things by reducing the amount of contaminants expelled to the exterior gas space, while at the same time providing improved wearer comfort and allowing the wearer to don a tightly fitting mask. The respirator that has an impactor element may not necessarily remove all particles from an exhale flow stream, but should remove at least 95%, usually at least about 98%, preferably at least about 99%, more preferably at least about 99.9%, and still more preferably at least 99.99% of the particles, when tested in accordance with the Bacterial Filtration Efficiency Test described below. The impactor element has an increased efficiency of at least about 70%, preferably at least about 75%, and most preferably at least about 80% over the same respirator that lacks the impactor element. Contaminants that are not removed from the exhale flow stream may nevertheless be diverted by the impactor element to a safer position.

The respirator preferably enables at least 75 percent of air that enters the interior gas space to pass through the exhalation valve and past the impactor element. More preferably, at least 90 percent, and still more preferably at least 95 percent, of the exhaled air passes through the exhalation valve and past the impactor element, as opposed to going through the filter media or possibly escaping at the mask periphery. In situations, for example, when the valves described in U.S. Pat. Nos. 5,509,436 and 5,325,892 to Japuntich et al. are used, and the impactor element demonstrates a lower pressure drop than the mask body, more than 100 percent of the inhaled air can pass through the exhalation valve and past the impactor element. As described in the Japuntich et al. patents, this can occur when air is passed into the filtering face mask at a high velocity. In some situations, greater than 100 percent of the exhaled air may pass out through the valve. This result is caused by a net influx of air through the filter media into the mask by aspiration.

Respirators that have an impactor element according to the invention have been found to meet or exceed industry standards for characteristics such as fluid resistance, filter efficiency, and wearer comfort. In the medical field, the bacterial filter efficiency (BFE), which is the ability of a mask to remove particles, such as bacteria expelled by the wearer, is typically evaluated for face masks. BFE tests are designed to evaluate the percentage of particles that escape from the mask interior. There are three tests specified by the Department of Defense and published under MIL-M-36954C, Military Specification: Mask, Surgical, Disposable (Jun. 12, 1975) which evaluate BFE. As a minimum industry standard, a surgical product should have an efficiency of at least 95% when evaluated under these tests.

BFE is calculated by subtracting the percent penetration from 100%. The percent penetration is the ratio of the number of particles downstream to the mask to the number of particles upstream to the mask. Respirators that use an integrally-disposed polypropylene melt-blown microfiber electrically-charged web as a filter media and have an impactor element according to the present invention are able to exceed the minimum industry standard.

Respirators also should meet a fluid resistance test where five challenges of synthetic blood are forced against the mask under a pressure of 5 pounds per square inch (psi) ($3.4\times10^4$ N/m$^2$). If no synthetic blood passes through the mask, it passes the test, and if any synthetic blood is detected, it fails. Respirators that have an exhalation valve and an impactor element according to the present invention have been able to pass this test when the impactor element is placed on the exterior or ambient air side of the valve. Thus, respirators of the present invention can provide good protection against splash fluids when in use.

EXAMPLES

Respirators that have an exhalation valve and a valve cover were prepared as follows. The exhalation valves that were used are described in U.S. Pat. No. 5,325,892 to Japuntich et al. and are available on face masks from 3M as 3M Cool Flow, Exhalation Valves. To prepare the valved face mask for testing, a hole two centimeters (cm) in diameter was cut in the center of a 3M brand 1860™, Type N95 respirator. The valve was attached to the respirator over the hole using a sonic welder available from Branson Ultrasonics Corporation (Danbury, Conn.).

Figure 11:
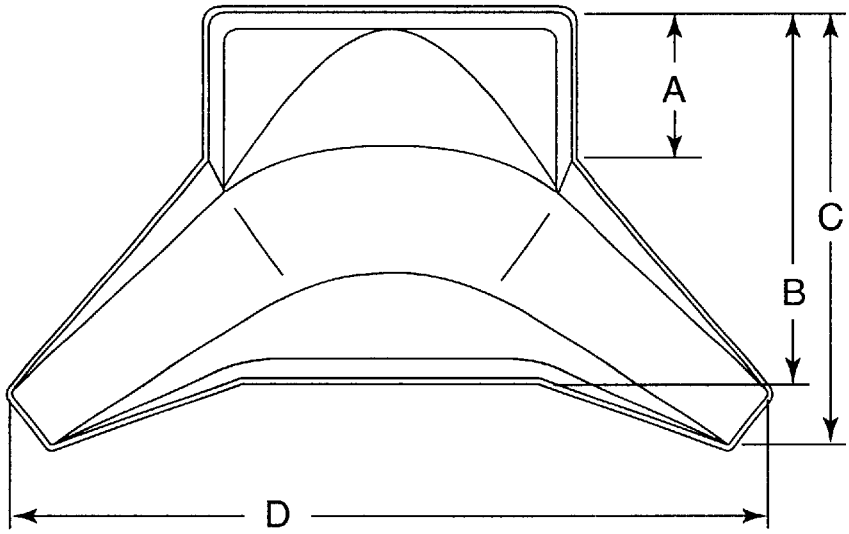
FIG. 11 is a front view of an impactor element, illustrating the dimension measurements used in the Examples section of this application.

Four impactor elements, Examples 1 though 4, were vacuum molded from 0.05 cm thick clear polystyrene film. The dimensions of each impactors, when referring to FIG. 11, are given in Table 1, below. The valve opening height $D_j$ in Table 1 was measured as is shown in FIG. 10 and represents the distance the valve opens at a given airflow and a given air velocity for the face mask pressure drop. The measurements were taken using the Normal Exhalation Test. Also provided in Table 1 is the impactor distance $Z_n$. $Z_n$ was measured as shown in FIG. 10 as the distance from the impactor inner surface perpendicular to a line drawn from the open diaphragm to the valve seat. For a valve opening width of 2 cm, the calculated square root of the Stokes number for a 3 micrometer water particle for the airflow of 79 lpm for the measured valve opening height was 1.01

TABLE 1

Dimensions for Impactor Elements with Respect to FIGS. 10 and 11

| Example | "A" (cm) | "B" (cm) | "C" (cm) | "D" (cm) | Impactor distance $Z_n$ (cm) | Valve Opening Height $D_j$ (cm) | Zn/Dj at 79 lpm |
|---|---|---|---|---|---|---|---|
| 1 | 1.1 | 3.5 | 4.6 | 7.6 | 0.70 | 0.42 | 1.7 |
| 2 | 1.8 | 4.8 | 4.5 | 6.1 | 1.77 | 0.42 | 4.2 |
| 3 | 1.5 | 3.6 | 4.5 | 7.5 | 0.64 | 0.42 | 1.5 |
| 4 | 1.8 | 3.8 | 4.2 | 7.1 | 0.58 | 0.42 | 1.4 |

Each of the impactors was removably attached to the exhalation valve by snapping the impactor onto the valve cover. Each respirator was evaluated for fluid resistance and % flow-through-the-valve according to the test procedures outlined below.

The Comparative Example was a 3M brand 1860™ respirator with an exhalation valve but with no impactor element attached to the exhalation valve.

Fluid Resistance Test

In order to simulate blood splatter from a patient's burst artery, a known volume of blood can be impacted on the valve at a known velocity in accordance with Australian Standard AS 4381–1996 (Appendix D) for Surgical Face Masks, published by Standards Australia (Standards Association of Australia), 1 The Crescent, Homebush, NSW 2140, Australia.

Testing performed was similar to the Australian method with a few changes described below. A solution of synthetic blood was prepared by mixing 1000 milliliters (ml) deionized water, 25.0 g "ACRYSOL G110" (available from Rohm and Haas, Philadelphia, Pa.), and 10.0 g "RED 081"dye (available from Aldrich Chemical Co., Milwaukee, WI). The surface tension was measured and adjusted so that it ranged between 40 and 44 dynes/cm by adding "BRIJ 30"™, a nonionic surfactant (available from ICI Surfactants, Wilmington, Del., as needed.

The mask, with the impactor element in place over the valve cover and with the valve diaphragm propped open, was placed 18 inches (46 cm) from a 0.033 inch (0.084 cm) orifice (18 gauge valve). Synthetic blood was squirted from the orifice and aimed directly at the opening between the valve seat and the open valve diaphragm. The valve was held open by inserting a small piece of foam between the valve seat cross members and the diaphragm. The timing was set so that a 2 ml volume of synthetic blood was released from the orifice at a reservoir pressure 5 psi $3.4\times10^4$ N/m$^2$). A piece of blotter paper was placed on the inside of the mask directly below the valve seat to detect any synthetic blood penetrating to the face side of the respirator body through the valve. The valve was challenged with synthetic blood five times. Any detection of synthetic blood on the blotter paper, or anywhere within the face side of the respirator, after five challenges was considered failure. No detection of blood within the face side of the respirator after five challenges was considered passing. The passage of synthetic blood through the respirator body was not evaluated.

Results of fluid resistance testing according to the method described above on respirators possessing impactor elements are shown in Table 2. The data in Table 2 show that impactor elements of the invention were able to provide good resistance to splashed fluids.

TABLE 2

Fluid Resistance of 3M ™ Cool Flow ™ Exhalation Valves Having An Impactor Element Mounted on 3M 1860 ™ Respirator

| Example | Fluid Resistance Test Results |
|---|---|
| Comparative | Fail |
| 1 | Pass |
| 2 | Pass |
| 3 | Pass |
| 4 | Pass |

Percent Flow Through Valve Test

Exhalation valves that had an impactor element were tested to evaluate the percent of exhaled air flow that exits the respirator through the exhalation valve and the impactor element as opposed to exiting through the filter portion of the respirator. The efficiency of the exhalation valve to purge breath is a major factor that affects wearer comfort. Percent flow through the valve was evaluated using a Normal Exhalation Text.

Figure 12:
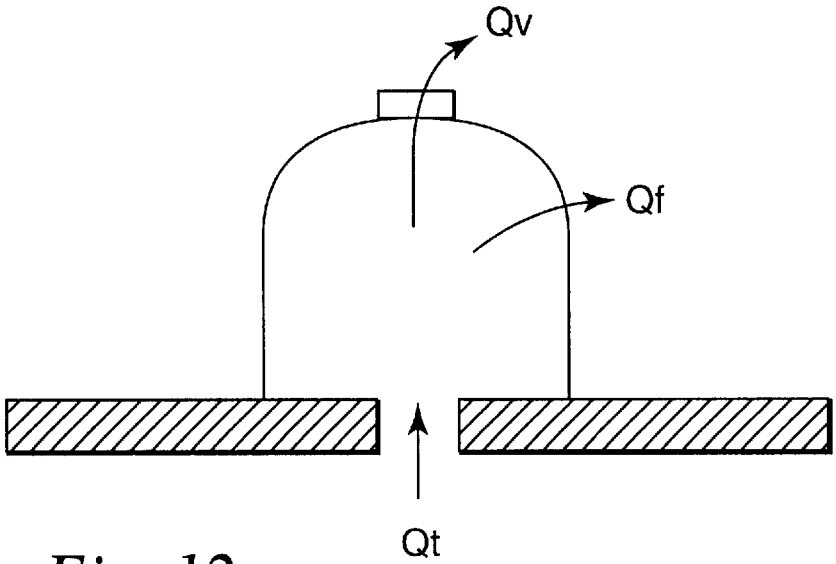
FIG. 12 is a schematic view illustrating airflow when performing a Percent Flow Through Valve Test.

The percent total flow was determined by the following method referring to FIG. 12 for better understanding. First, the linear equation describing the mask filter media volume flow ($Q_f$) relationship to the pressure drop ($\Delta P$) across the face mask was determined while the valve was held closed. The pressure drop across the face mask with the valve allowed to open was then measured at a specified exhalation volume flow ($Q_\tau$). The flow through the face mask filter media $Q_f$ was determined at the measured pressure drop from the linear equation. The flow through the valve alone ($Q_v$) was calculated as $Q_v=Q_\tau-Q_f$. The percent of the total exhalation flow through the valve was calculated by $100\times(Q_\tau-Q_f)/Q_\tau$.

If the pressure drop across the face mask is negative at a given $Q_\tau$, the flow of air through the face mask filter media into the mask interior will also be negative, giving the condition that the flow out through the valve orifice $Q_v$ is greater than the exhalation flow $Q_\tau$. Thus, when $Q_f$ is negative, air is actually drawn inwards through the filter during exhalation and sent through the valve, resulting in a percent total exhalation flow greater than 100%. This is called aspiration and provides a cooling effect to the wearer.

Results of testing on constructions having impactor elements according to the invention are shown below in Table 3.

TABLE 3

Percent Flow Through the Valve at 42 and 79 liters/minute (LPM) of 3M ™ Cool Flow ™ Exhalation Valves Having Impactor Elements Mounted on 3M 1860 ™ Respirators

| Example | Exhale Air Flow Through Valve (%) |
|---|---|
| Comparative | 116% |
| 1 | 103% |
| 2 | 101% |
| 3 | 100% |
| 4 | 107% |

The data in Table 3 demonstrate that good flow percentages through the exhalation valve and past the impactor element can be achieved under a Normal Exhalation Test.

Bacterial Filtration Efficiency Test

The impactor elements were tested to determine the amount of particulate material that passes through the exhalation valve and that becomes deflected or caught by the impactor element. The Bacterial Filtration Efficiency Test is an in vivo technique for evaluating the filtration efficiency of surgical face masks. This means that the efficiency of a mask is measured using live microorganisms produced by a human during mask use.

The procedure, as described in V. W. Green and D. Vesley, *Method for Evaluating Effectiveness of Surgical Masks*, 83 J. BACT 663–67 (1962), involves speaking a given number of words within an allotted time period while wearing the test mask. Mouth generated droplets that contain microorganisms that escape capture by the mask are contained in a test chamber and are drawn by vacuum into an Andersen sampler, (Andersen, A. A., *New Sampler for the Collection, Sizing and Enumeration of Viable Particles*, 76 J. BACT. 471–84 (1958)) where the microorganisms are captured on plates having agar bacterial growth culture medium. A control test, performed without a mask over the speaker's mouth, is used to calculate the percentage efficiency of the sample mask (i.e., the CONTROL example).

The procedure described by Green and Vesley evaluates mask media efficiency and facial fit by monitoring the number of particles not captured by the mask. In the present test, the respirator masks used for the testing, that is, the 3M 1860™ Respirators, Type N95, have a sufficiently high media efficiency and good facial fit so that the majority of measured microorganisms were those that passed out through the exhalation valve. To minimize any face seal leakage, the respirators were each fit tested using the 3M Company FT-10 Saccharin Face Fit Test (commercially available from 3M) prior to the testing. The maximum distance the valve diaphragm could open was 0.65 cm.

The tests were performed according to the Green and Vesley procedure by Nelson Laboratories, Inc., Salt Lake City, Utah. The chamber was constructed as detailed by Green and Vesley. It consisted of a 40.6 cm ×40.6 cm ×162.6 cm chamber that was supported by a metal frame. The lower portion of the chamber tapered to a 10.2 cm square bottom perforated for the attachment of an Andersen Sampler. The summation of all of the viable particles captured on the six stages of the Andersen Sampler were used to evaluate the aerosol challenge. The airflow through the Sampler was maintained at 28.32 liter/min, and all the Sampler plates contained soybean case in digest agar. After sampling, the plates contaminated with microorganisms were incubated at 37° C.+/−2° C. for 24–48 hours.

After incubation, the organisms on the plates were counted, and the counts were converted to probable hits employing the conversion charts of Andersen (1958). The mass median aerodynamic particle diameter of the mouth-generated particles was 3.4 micrometers, calculated according to the Andersen (1958) procedure. The Percent Bacterial Filtration Efficiency (BFE) was calculated as:

$$\% \text{ BFE}=[(A-B)/A]\times 100$$

where:

A=Control counts without a mask (i.e., CONTROL example)

B =Test sample counts (i.e., Examples 1–4)

Two samples of each of four Example exhalation valve cover impactors were tested. The average results of the two tests for the samples are shown in the Table 4 below. The results reported for the Comparative Example were the average of two replicates where no impactor element was installed on the exhalation valve.

The impactor efficiency of the valves that had impactor elements mounted on the valves, when compared to the valves without impactors, is reported in the last column in Table 4. Impactor efficiency is calculated as:

$$\% \text{ IMPACTOR EFFICIENCY}=[(C-D)/C]\times 100,$$

where:

C=Counts with no impactor present (i.e., Comparative example)

D=Counts with impactor present

TABLE 4

Bacterial Filtration Efficiency Test Results of 3M 1860 ™ Respirators that have Cool Flow ™ Exhalation Valves and Impactor Elements Mounted on the Respirators

| Example | Impactor Distance (cm) at 79 lpm | Anderson Sampler Total Bacterial Counts | BFE % Efficiency | % Impactor Efficiency |
|---|---|---|---|---|
| CONTROL | — | 37672 | — | — |
| Comparative | — | 14.0 | 99.9628 | — |
| 1 | 0.70 | 3.0 | 99.9920 | 78.6 |
| 2 | 1.77 | 3.5 | 99.9907 | 75.0 |
| 3 | 0.64 | 2.5 | 99.9934 | 82.1 |
| 4 | 0.58 | 2.5 | 99.9934 | 82.1 |

The data shows that a bacterial filtration efficiency increase of about 0.03 percent was achieved when an impactor element was used in combination with a filtering face mask having a valve, when compared to a face mask having a valve with no impactor element used. Any increase in efficiency, even 0.01%, is a noticeable improvement in that the number of particles that could potentially come into contact with a patient or other external surface is reduced. The data further shows that use of an impactor element reduced the amount of particulate material that passed through the exhalation valve by 75–82% in these examples, providing a respiratory mask having an exhalation valve that has a bacterial filtration efficiency (BFE) in excess of 99.99%.

The results also show an increase in impactor efficiency and BFE percentage as the distance between the impactor and the exhalation valve decreases, which is predicted by impactor theory, discussed above in the Detailed Description.

All of the patents and patent applications, cited above, including those in the Background Section, are incorporated by reference into this document in total.

This invention may be suitably practiced in the absence of any element not specifically described in this document.

What is claimed is:

1. A negative pressure respirator that comprises:

(a) a mask body that defines an interior gas space and an exterior gas space, the mask body comprising an integrally-disposed inhale filter layer for filtering inhaled air that passes through the mask body;

(b) an exhalation valve disposed on the mask body, the exhalation valve having a valve diaphragm and at least one orifice, the valve diaphragm and the orifice being constructed and arranged to allow an exhale flow stream to pass from the interior gas space to the exterior gas space; and (c) an impactor element that is disposed on the exhalation valve in the exhale flow stream;

wherein the exhalation valve and impactor element provide the respirator with a ratio of $Z_n/D_j$ of less than about 5.

2. The negative pressure respirator of claim 1, wherein the impactor element is constructed and arranged to obstruct the view of the valve diaphragm.

3. The negative pressure respirator of claim 1, wherein the respirator further includes a means for supporting the respirator about a wearer's head and a conformable nose clip for adapting the mask body over a wearer's nose.

4. The negative pressure respirator of claim 3, wherein the inhale filter layer in the mask body comprises a layer of electrically-charged, melt-blown, microfibers.

5. The negative pressure respirator of claim 4, wherein the mask body also includes inner and outer cover webs that are disposed on opposing sides of the inhale filter layer.

6. The negative pressure respirator of claim 1, wherein the integrally-disposed inhale filter element layer includes a layer of entangled, electrically-charged, meltblown microfibers, and wherein the mask body further includes a shaping layer that provides structural integrity to the mask body.

7. The negative pressure respirator of claim 1, wherein the exhalation valve includes a valve seat and a single flexible flap that is mounted to the valve seat in cantilevered fashion, the flexible flap having a free end that is disposed away from and below a fixed end of the flap when the mask is worn, the free end being free to be lifted from the valve seat when a significant pressure is reached during an exhalation.

8. The negative pressure respirator of claim 1, wherein the exhalation valve includes a valve cover that has valve ports, the impactor element covering a majority of the valve cover and the valve ports.

9. The negative pressure respirator of claim 1, wherein at least 99% of any particles within the exhale flow stream are prevented from passing from the interior gas space to the exterior gas space, when tested in accordance with a Bacterial Filtration Efficiency Test.

10. The negative pressure respirator of claim 1, wherein at least 99.9% of any particles within the exhale flow stream are prevented from passing from the interior gas space to the exterior gas space, when tested in accordance with a Bacterial Filtration Efficiency Test.

11. The negative pressure respirator of claim 1, wherein at least 99.99% of the particles within the exhale flow stream are prevented from passing from the interior gas space to the exterior gas space, when tested in accordance with a Bacterial Filtration Efficiency Test.

12. The negative pressure respirator of claim 1, wherein the impactor element is located in the exhale flow stream and removes particles from it by sharply redirecting the flow after it passes through the valve orifice.

13. The negative pressure respirator of claim 1, wherein the impactor element deflects substantially all of the air in the exhale flow stream at least 90 degrees.

14. The negative pressure respirator of claim 1, wherein the impactor element diverts the exhale flow stream from its original path by an angle of 100 degrees or more.

15. The negative pressure respirator of claim 1, wherein the impactor element diverts the exhale flow stream from its original path by an angle of 135 degrees or more.

16. The negative pressure respirator of claim 1, wherein the impactor element diverts the exhale flow stream from its original path by an angle of 165 degrees or more.

17. The negative pressure respirator of claim 1, wherein the impactor element is transparent.

18. The negative pressure respirator of claim 1, wherein the impactor element is adapted such that the placement in the exhale flow stream puts the impactor element in a path of least resistance when a person exhales.

19. The negative pressure respirator of claim 1, wherein the mask body has an opening disposed therein, the exhalation valve being disposed on the mask body at the opening, and wherein the exhalation valve includes a valve cover.

20. The negative pressure respirator of claim 19, wherein the impactor element is positioned on the valve cover.

21. The negative pressure respirator of claim 1, wherein the impactor element is removable.

22. The negative pressure respirator of claim 19, wherein the impactor element is integral with the valve cover.

23. The negative pressure respirator of claim 1, wherein the impactor element and the valve cover are one-and-the-same.

24. The negative pressure respirator of claim 1, wherein at least 100% of air that enters the interior gas space to pass through the exhalation valve and is deflected by the impactor when tested in accordance with a Percent Flow Through Valve Test.

25. The negative pressure respirator of claim 1, which is able to pass a Fluid Resistance Test.

26. The negative pressure respirator of claim 1, wherein the impactor element includes a front plate that is disposed in the path of the exhale flow stream.

27. The negative pressure respirator of claim 26, wherein the impactor element further includes a trough that assists in retaining particles that are captured by the impactor element.

28. The negative pressure respirator of claim 26, wherein the impactor element further includes left and right deflectors disposed on opposing sides of the front plate.

29. The negative pressure respirator of claim 1, wherein the impactor element is constructed from a molded plastic that is about 2.5 to 5 centimeters high and has a span of about 2.5 to 7.5 centimeters.

30. The negative pressure respirator of claim 1, wherein the impactor element is spaced about 0.1 to 2 centimeters from the diaphragm of the exhalation valve.

31. The negative pressure respirator of claim 30, wherein the impactor element is spaced less than 1.5 centimeters from the closest distance to the diaphragm under a Normal Exhalation Test.

32. The negative pressure respirator of claim 1, wherein the $Z_n$ to $D_j$ ratio is less than about 4.

33. The negative pressure respirator of claim 32, wherein the $Z_n$ to $D_j$ ratio is less than about 2 and is greater than 0.5.

34. The negative pressure respirator of claim 33, wherein the $Z_n$ to $D_J$ ratio is greater than 1.

35. The negative pressure respirator of claim 34, wherein the $Z_n$ to $D_j$ ratio is greater than 1.2.

36. The negative pressure respirator of claim 1, wherein the impactor element increases particle capture according to a bacterial filtration efficiency test by at least 70% over the same respirator that lacks the impactor element.

37. The negative pressure respirator of claim 1, wherein the impactor element increases particle capture according to a bacterial filtration efficiency test by at least 75% over the same respirator that lacks the impactor element.

38. The negative pressure respirator of claim 1, wherein the impactor element increases particle capture according to the bacterial filtration efficiency test by at least 80% over the same respirator that lacks the impactor element.

39. A method of removing contaminants from an exhale flowstream, the method comprising placing the respirator of claim 1 over at least a wearer's nose and mouth and then exhaling air such that a substantial portion of the exhaled air is deflected by the impactor element.

* * * * *

UNITED STATES PATENT AND TRADEMARK OFFICE

CERTIFICATE OF CORRECTION

PATENT NO. : 6,460,539 B1
DATED : October 8, 2002
INVENTOR(S) : Japuntich, Daniel A.

It is certified that error appears in the above-identified patent and that said Letters Patent is hereby corrected as shown below:

Column 4,
Line 22, “texterior” should read as -- exterior --.

Signed and Sealed this

Twenty-fifth Day of February, 2003

JAMES E. ROGAN
*Director of the United States Patent and Trademark Office*